US007857075B2

(12) United States Patent
Jeffryes

(10) Patent No.: US 7,857,075 B2
(45) Date of Patent: Dec. 28, 2010

(54) WELLBORE DRILLING SYSTEM

(75) Inventor: Benjamin P. Jeffryes, Cambridge (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 27 days.

(21) Appl. No.: 11/946,968

(22) Filed: Nov. 29, 2007

(65) Prior Publication Data

US 2009/0139767 A1 Jun. 4, 2009

(51) Int. Cl.
*E21B 7/00* (2006.01)

(52) U.S. Cl. ..... 175/57; 175/40; 175/48

(58) Field of Classification Search ..... 175/40, 175/48, 57

See application file for complete search history.

(56) References Cited

U.S. PATENT DOCUMENTS 3,720,261 A * 3/1973 Heilhecker et al. ..... 166/208
5,721,376 A * 2/1998 Pavone et al. ..... 73/152.47
5,984,011 A * 11/1999 Misselbrook et al. ..... 166/312
6,527,062 B2 * 3/2003 Elkins et al. ..... 175/25
7,096,961 B2 * 8/2006 Clark et al. ..... 166/380
7,243,735 B2 * 7/2007 Koederitz et al. ..... 175/40
2005/0032652 A1 * 2/2005 Kirsner et al. ..... 507/100
2005/0087367 A1 * 4/2005 Hutchinson ..... 175/45
2005/0189142 A1 * 9/2005 Garcia et al. ..... 175/24
2006/0225926 A1 10/2006 Madhavan et al.
2007/0261848 A1 * 11/2007 Benton ..... 166/288

* cited by examiner

*Primary Examiner*—Thomas Bomar
*Assistant Examiner*—Elizabeth C Gottlieb
(74) *Attorney, Agent, or Firm*—David J. Smith; Dave R. Hofman; Brigitte L. Echols

(57) ABSTRACT

A method related to restarting a drilling process includes the steps of applying a surface torque to a drill string in a borehole, detecting signals related to one of a torque and a rotational speed experienced at a bottom hole assembly, initiating drilling fluid flow, and lowering a drill bit to a bottom of the borehole. The surface torque or the drilling fluid flow is maintained or changed based on the signals related to the torque or rotational speed.

13 Claims, 2 Drawing Sheets

WELLBORE DRILLING SYSTEM

TECHNICAL FIELD

The present invention relates to wellbore drilling operations.

BACKGROUND

Wellbores are drilled in the Earth from the surface to one or more subsurface formations typically by rotating a drillbit against the formation. The drill bit is typically suspended in the borehole by a drill string that extends to the surface. In one example, the drill bit may be rotated by rotating the drill string at the surface. Example of surface rotating systems include a rotary table and a top drive. In another example, the drill bit may be driven by a downhole motor, typically referred to as a "mud motor," which is typically a component in the drill string, located adjacent to the bit.

In a typical drilling system, the drill string defines a flow passage through which drilling fluid, typically referred to as "drilling mud," is pumped. The mud flows down the drill string to the drill bit, where it exits through jets in the drill bit. The mud then flows up the annulus between the borehole wall and the drill string, carrying drill cuttings to the surface. Through this process, the mud cools the drill bit and cleans the bottom of the borehole from the drill cuttings that are created as the drilling process progresses.

The mud is also weighted with the addition of various compounds so that the hydrostatic pressure in the borehole is higher than the formation pressure, thereby preventing a well blowout in the event a pressurized subsurface pocket is encountered by the drill bit. It is noted that some wells are drilled using a technique called under balanced drilling, where the mud pressure does not quite compensate for the formation pressure.

Most drilling fluids are a fluid that will gel when the fluid is not pumping. This prevents the drill cuttings from falling back down the hole or from collecting on the low side of a deviated well. If mud flow is stopped, the shear stress in the gel must exceed a certain amount to allow the mud to flow again.

SUMMARY

In one aspect, the disclosed examples relate to a method for restarting a drilling process that includes applying a surface torque to a drill string in a borehole, detect signals related to one of a torque and a rotational speed experienced at a bottom hole assembly, initiating drilling fluid flow, and lowering a drill bit to a bottom of the borehole.

In another aspect, the disclosed examples relate to a method for restarting a drilling process that includes lowering a drill string, detecting signals related to one of a torque and a rotational speed experienced at a bottom hole assembly, initiating a flow of drilling fluid, engage Kelly bushings, and applying a surface torque to a drill string in a borehole.

In another aspect, the disclosed examples relate to a method of restarting drilling operations in a wellbore after drilling operations and circulation of a drilling mud have ceased. The method includes providing a wired drill string having a drill bit in the wellbore, downhole sensors positioned in the wellbore and in communication with a controller via the wired drill string, a pumping system to circulate drilling fluid, a rotation system for applying rotation to the drill string and drill bit, a translation system for raising and lowering the drill string relative to the wellbore, obtaining data at the controller obtained from the downhole sensors communicated via the wired drill pipe, operating the rotation system so as to apply torque to the wired drill string, and initiating the pumping system to circulate drilling fluid at a first flow rate upon receiving data at the controller from the downhole sensors indicating that a downhole transient pressure surge has passed.

In another aspect, the disclosed examples relate to a method for restarting a drilling process that includes step for generating enough shear stress in a gelatinous drilling fluid located in an annulus to cause the gelatinous drilling fluid in the annulus to flow, step for lowering a drill bit to a bottom of a borehole, and step for generating enough shear stress in a gelatinous drilling fluid located in a drill pipe gelatinous drilling fluid in the drill pipe to flow.

The foregoing has outlined some of the features and technical advantages of the present invention in order that a detailed description of an example of the invention that follows may be better understood. Additional features and advantages of the invention will be described hereinafter which form the subject of the claims of the invention.

BRIEF DESCRIPTION OF THE DRAWINGS

The foregoing and other features and aspects of the present invention will be best understood with reference to the following detailed description when read in conjunction with the accompanying drawings, wherein.

DETAILED DESCRIPTION

Figure 1:
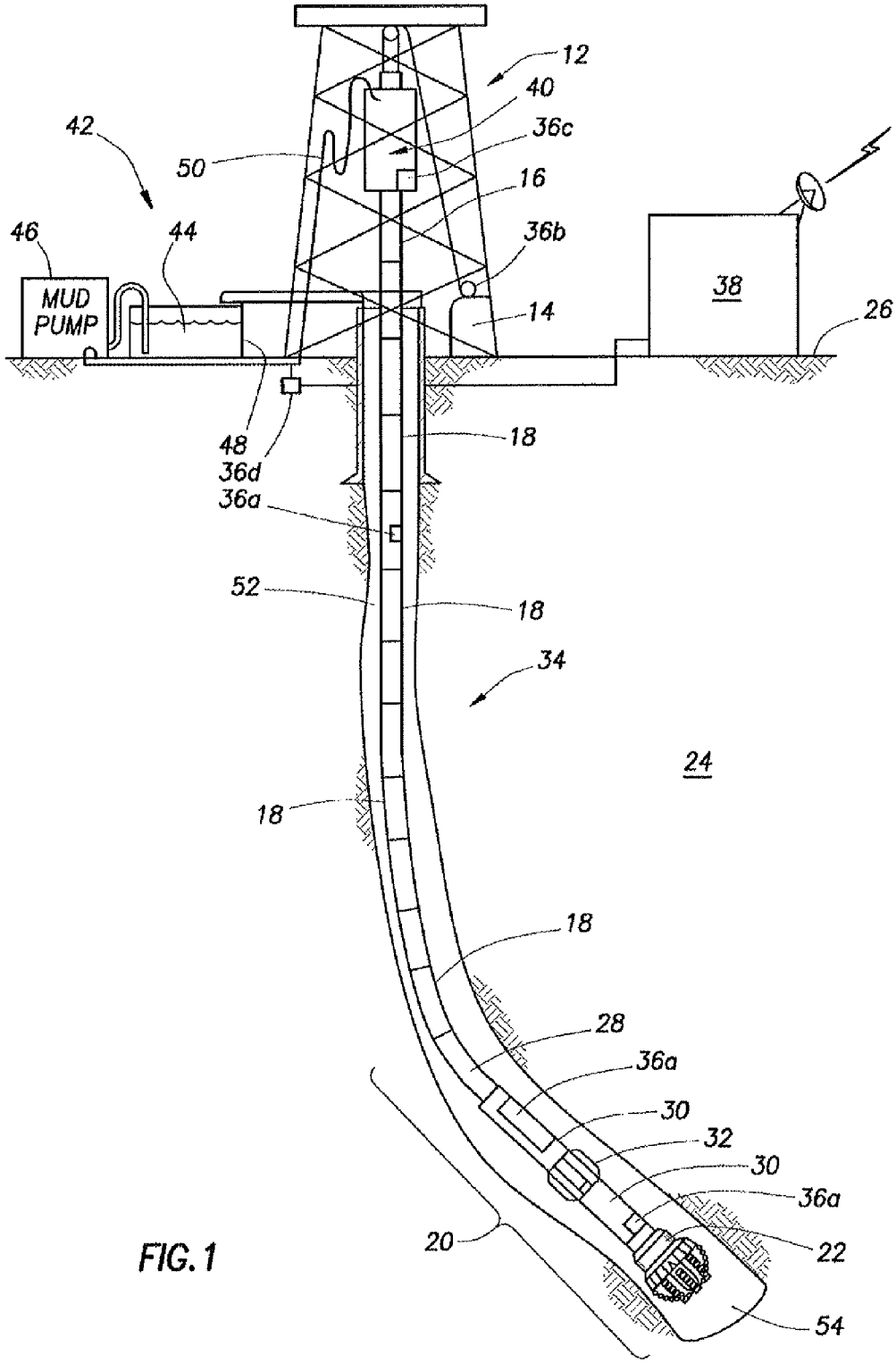
FIG. 1 illustrates an example of a wellbore drilling system.

Refer now to the drawings wherein depicted elements are not necessarily shown to scale and wherein like or similar elements are designated by the same reference numeral through the several views.

As used herein, the terms "up" and "down"; "upper" and "lower"; "uphole" and "downhole"; and other like terms indicating relative positions to a given point or element are utilized to more clearly describe some elements of the embodiments of the invention. Commonly, the terms "up," "upper," "uphole," and other like terms are meant to indicate a position that is closed to the surface along the linear distance of the borehole. It is noted that through the use of directional drilling, a wellbore may not extend straight up and down. Thus, these terms describe relative positions along the wellbore.

FIG. 1 provides an example of a wellbore drilling system of the present invention, generally designated by the numeral 10. A drilling rig 12 includes drawworks 14 to raise, suspend and lower a drillstring 16. Drillstring 16 includes a number of threadedly coupled sections of drillpipe, shown generally at 18. The sections of drillpipe 18 may be single joints of drillpipe or stands of made-up joints of drillpipe. In some examples, drill pipe 18 is wired drill pipe, which provides high-speed, two-way communication between surface and downhole systems, independent of the flow of fluid in drillstring 16 or the wellbore. For example, wired drill pipe may have data cables for transmitting various types of electronic signals and couplers, such as inductive couplers at the respective pipe ends, for communicating with the next section of wired drill pipe. Examples of wired drill pipe are disclosed in U.S. Patent Application Publication No. 2006/0225926, which is incorporated herein by reference.

A bottom hole assembly (BHA) 20 is located at the bottom end of the drill string 16. The BHA includes a drill bit 22 to cut through earth formations 24 below the earth's surface 26, as well as various sensors, actuators, and other devices that are known in the art. BHA 20 may include various devices such as weighted drillpipe 28, drill collars 30, and one or more stabilizers 32 adapted to keep BHA 20 roughly in the center of the wellbore 34 during drilling of wellbore 34.

The drilling system 10 includes one or more sensors 36 for measuring parameters associated with wellbore conditions and the drilling equipment. In various examples, sensors 36 may be located at the surface, various positions along the drill string 16, and in the BHA 20. In the example shown in FIG. 1, sensors 36*a* represent sensors in the BHA 20, sensors 36*e* represent sensors located at various positions along the drill string 16, and sensors 36*b*, 36*c*, and 36*d* represent sensors located at or near the surface. In FIG. 1, the sensors are shown to illustrate a location of the sensor. Thus, sensor 36*a* is meant to indicate a sensor located in the BHA 20. Such a sensor may be any type of sensor, and it may relate to more than one sensor. Thus, a description of sensor 36*a* as a temperature sensor is meant to indicate the position of the temperature sensor, and not to exclude a pressure or other sensor from the example.

The sensors 36 may include any type of sensor, such as pressure, temperature, accelerometer, magnetometer and strain sensors. In some examples a sensor may include various measurement while drilling (MWD) and logging while drilling (LWD) sensors, as are known in the art.

Telemetry for downhole sensors 36*a*, 36*e* may be provided by wired drill pipe to a central processing unit 38, referred to herein generally as a control system. A wired drill pipe system may provide a high-speed, low-latency communications network between downhole elements and the surface.

Drawworks 14 provides a mechanism for lifting, lowering and supporting drillstring 16. Drawworks system 14 may also include slips and other equipment generally known in the industry but not illustrated in detail. During active drilling drawworks 14 is operated to apply a selected axial force (weight on bit—"WOB") to the drill bit 22. Such axial force results from the weight of the drillstring 16, a large portion of which is suspended by drawworks 14. The unsuspended portion of the weight of drillstring 16 is transferred to the bit 22 as WOB.

Drawworks 14 is also used to lift and lower the drillstring 16 in wellbore 24 for non-drilling operations, such as tripping in or out of the well, and suspending the drill bit 22 off the bottom of the borehole while a new stand of pipe is added. A sensor 36*b* may be functionally connected within drawworks 14 to identify for example the rate of translation of drillstring 16 or the hook load.

System 10 may include a surface mechanism for rotating drillstring 16 and thus drill bit 22, denoted generally herein as rotation system or mechanism 40. In the illustrated example, rotating mechanism 40 is illustrated as a top drive, or power swivel, but may also be a rotary table with kelly bushing. In other examples, the mechanism for rotating drill bit 22 may be provided in whole or part by a hydraulic motor or other downhole rotating mechanism not shown in detail herein. One or more sensors 36*c* may be in functional connection with the rotation mechanism 40 to provide data such as for example the rotational speed of drillstring 16 and the torque applied to the drill string 16. Sensors 36*c* may be in functional connection with control unit 38 for communicating the signals from these sensors. The various sensors may allow for determination of rotational speed of drillstring 16 at the surface, the axial load suspended by the drawworks 14, and the torque applied to the drillstring 16.

System 10 further includes a pumping system, generally denoted by the numeral 42, for circulating drilling fluid 44 or "mud" during drilling operations. Pumping system 42 may include without limitation a pump 46, tank 48, standpipe assembly 50, and drillstring 16. While drillstring 16, including BHA 20 and bit 22, are rotated, pump 46 circulates mud 44 from tank 48 (or pit) through standpipe assembly 50 to drillstring 16. Mud 44 flows through the interior of drillstring 16 discharging through drillbit 22 into wellbore 34. Mud 44 flows back up annulus 52 carrying the drilling cuttings back to tank 48.

Pumping system 42 includes in the illustrated example a sensor 36*d*, such as a pressure transducer that generates an electrical signal or other type of signal corresponding to the mud pressure. One or more sensors 36*d* may be positioned so as to determine the mud pressure without limitation at pump 46, standpipe 50, and annulus 52.

Control system 38 is in communication with sensors 36 and may be in operational connection with drawworks 14, rotation system 40 and pumping system 42. Control system 38 may include circuits for recording signals generated by the various sensors 36 and to control the various drilling systems, such as mud pumping and rotations and translation of drillstring 16.

From time to time it is necessary to terminate or substantially terminate the circulation of mud 44 through the drilling system. This is most frequently done when an additional section of drillpipe 18 is connected to the top end of the drillstring 16 to lengthen the drill string. Typically, when it is necessary to add sections of drill pipe, the rotation and mud flow is stopped, and the drill bit 22 is lifted off of the bottom of the borehole. To restart or initiate drilling operations, the circulation of mud 44 must be started, drillstring 16 must be translated down so that bit 22 is in position to make hole and rotation of bit 22 and typically drillstring 16 will commence.

During the transition from stop to conducting drilling operations there can be pressure increases that damage the formation and/or equipment on BHA 20. For example, translation of the pipe can cause a pressure surge. Additionally, there may be rheological changes in the drilling mud 44 after remaining idle. For example, a typical mud 44 will gel when not flowing, thus requiring that a threshold shear stress be overcome before mud 44 will flow again. In order to limit damage to formation 24 and drillstring 16, downhole conditions, such as pressure, are monitored; the motion of drillstring 16, in particular drillbit 22 or BHA 20, and circulation of mud 44 are also monitored and controlled.

Figure 2:
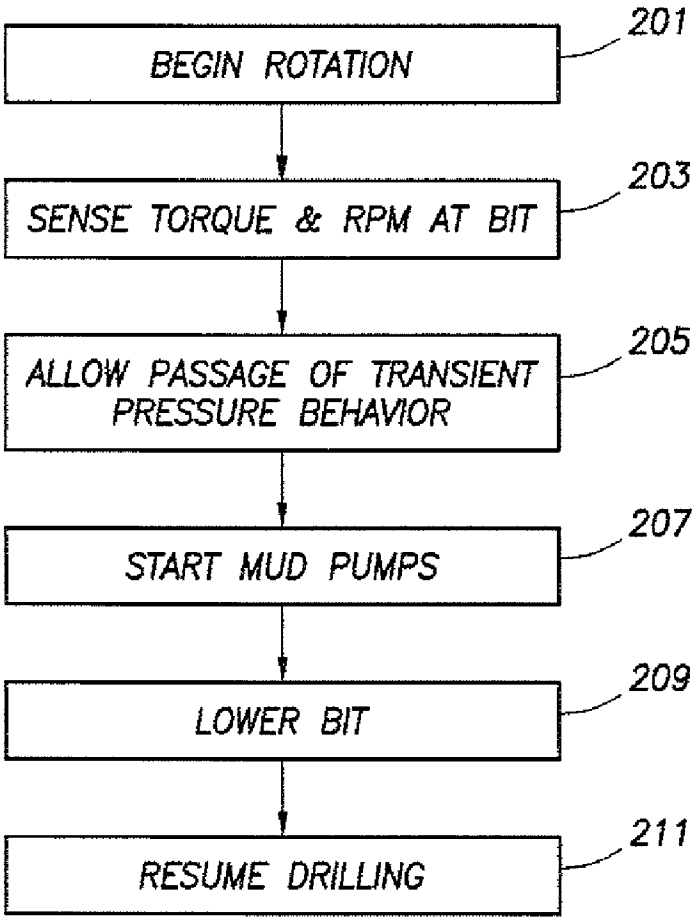
FIG. 2 illustrates and example method for restarting drilling.

An example of a method for starting drilling operations is now provided. For purposes of description the example is described with reference to a top drive rotation system and startup after ceasing drilling operations to make-up a section of drillpipe 18 into drillstring 16, as shown in FIG. 2.

Rotation system 40 is initiated, for example by controller 38, so as to slowly increase the torque applied to drillstring 16, at step 201. In this example, the rotary system 40 may be a top drive system that is capable of rotating the drill string before it is lowered. A bottomhole torque sensor 36*a* communicates data via wired drillstring 16 to controller 38, at step 203. A torque sensor 36*c* at rotation system 40 communicates the torque applied directly to drillstring 16. Sensor 36*a* communicates to controller 38 that a torque increase occurs downhole, for example at BHA 20. Controller 38 maintains rotation mechanism 40 at a set torque until bottomhole motion sensors (for instance either accelerometers or magnetometers) 36*a* indicates that rotational motion has been initiated.

Note that surface torque is transmitted downhole at approximately 3000 meters per second in a steel drillstring. When downhole torque sensor 36*a* detects a rise in the torque, the bottomhole torque will continue to increase although the surface torque is maintained at a constant level. If BHA 20 does not move after the transit time of the rotational waves has lapsed, then mechanism 40 may be operated by controller 38 to gradually increase the surface torque. Once motion has been initiated, the surface torque should be reduced to around 60% of the level that was required to initiate motion, due to the lower friction when the drillpipe is rotating. Rotation speed can then be gradually brought up to the desired level.

A downhole sensor 36*a* communicates via wired drillstring 16 pressure data to control system 38. A pressure change will be detected as the gel structure of mud 44 is altered and its viscosity is reduced, at step 205. Once this initial transient behavior of the downhole pressure has passed, pump 46 or circulation system 42 is started, at step 207. For example, once the downhole transient pressure has passed, controller 38 initiates pump 46 to circulate mud 44 at a steady low rate. Although the mud in annulus 52 may be liquid, because of the shear stresses induced by rotation of the drillstring, the mud in drillstring 16 may still be gelatinous. A rise in a bottomhole pressure of mud 44 inside of drillstring 16, communicated by a sensor 36*a* to controller 38, indicates that all of mud 44 in system 10 is flowing. Controller 38 may then initiate pump 46 to increase flow rate until a surface sensor 36*d* indicates that mud 44 is flowing through annulus 52. Controller 38 may then operate pump 46 at a specified full flow rate for drilling operations. Changes in annular measurements of temperature are also an indicator of mud motion in the annulus and may used to track how much of the mud column in the annulus is moving. Temperatures measured by sensors 36*a* along the drillstring will rise if mud that has been deeper than the sensor moves past them, and then will reduce as fresher circulating mud reaches them. In order to reach full downhole flow rate as fast as possible, the surface flow rate can be programmed to overshoot the required steady rate and then drop back, without either exceeding surface pressure ratings, or bottomhole flow rate limits.

Once a steady flow mud rate is reached, or other desired mud flow rate, then bit 22 may be lowered to the bottom 54 of wellbore 34 by translation system 14, at step 209, and drilling may be resumed, at step 211. Controller 38 controls the rate of translation of drillstring 16 so as to minimize the surge pressure in wellbore 34 and to avoid damaging formation 24. This is done by making velocity changes smooth, and by timing the motion so that the fundamental resonance of fluid in the annulus is not excited (this requires that the total time taken is not close to half the period of that resonance).

Figure 3:
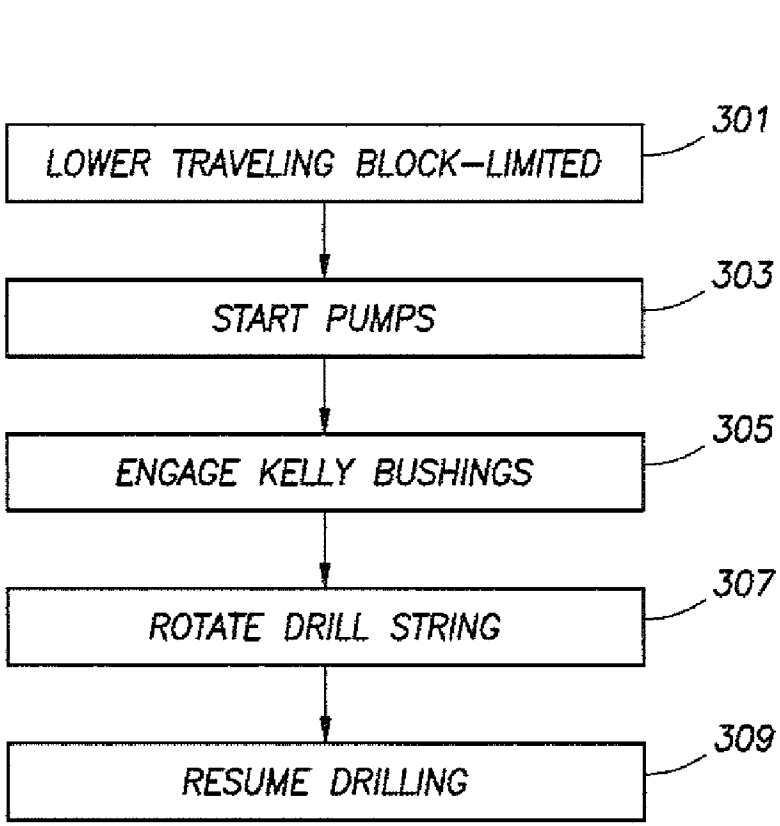
FIG. 3 illustrates another example method for restarting drilling.

In another example method, shown in FIG. 3, the rotation system may be a rotary table. Using a rotary table, it may be impossible to begin rotation of the drill string before the drill string is lowered so that the Kelly bushings are engaged. In this example, the method first includes lowering the traveling block until the effects of the motion are observed in the bottom hole weight and motion sensors, at step 301. Next, the mud pumps may be started, at step 303. The mud pump start sequence may be initiated in a similar manner to the top-drive case, except that once the fluid near the bit has started flowing, the flow rate must be sufficient to compress the gelled mud in the annulus to the point where the shear stress exceeds the yield stress of the gel.

The velocity of the descending drill string and the mud flow must be controlled so that the surge pressure, combined with the hydraulic pressure, does not exceed the desired limits. In one example, the lowering of the drill string and the mud flow rate are controlled by the controller 38.

As the traveling block and the drill string are lowered, the Kelly bushings will approach the rotary table. The descent of the drill string may be slowed, and the Kelly bushings are brought into engagement with the rotary table, at step 305. Once the Kelly bushings are engaged, the drill string may be rotated, at step 307, and drill in may continue, at step 309.

In normal drilling, connections are frequent events, and so the response of the system at start up following one connection should be very similar to that at the previous connection. This similarity can be used by the system to modify the automated start-up sequence so as to minimize the total time taken without resulting in undesirable downhole pressures or motions. For instance, if during one start-up sequence the downhole pressure variations are well within the desired limits, the parameters used (eg the plateau flow rates, the rate of increase before the annulus is in motion, or the overshoot flow rate) can be increased until the pressure variations are at the limits, minus a safety margin.

The processes may either be entirely automated, partially automated (for instance, the driller still decides when start the pumps or block motion, but does not control the sequence once initiated), or may be in the form of presenting to a human operator the optimal parameters to use and times at which to start operations, or over-ride limits to prevent damage resulting from the human operators actions From the foregoing detailed description of specific embodiments of the invention, it should be apparent that a wellbore drilling system and method that is novel has been disclosed. Although specific examples have been disclosed herein in some detail, this has been done solely for the purposes of describing various features and aspects of the invention, and is not intended to be limiting with respect to the scope of the invention. It is contemplated that various substitutions, alterations, and/or modifications, including but not limited to those implementation variations which may have been suggested herein, may be made to the disclosed examples without departing from the spirit and scope of the invention as defined by the appended claims which follow.

What is claimed is:

1. A method for restarting a drilling process, comprising:

applying a surface torque to restart a drill string in a borehole;

detecting signals related to torque and a rotational speed experienced at a bottom hole assembly wherein the surface torque is maintained either until the bottom hole assembly rotates or after a predetermined time, and then the surface torque changes based on an indication of rotation of the bottom hole assembly;

initiating drilling fluid flow upon detection of rotation of the drill string at the bottom hole assembly; and lowering a drill bit to a bottom of the borehole.

2. The method of claim 1, further comprising allowing passage of a transient pressure behavior before initiating drilling fluid flow.

3. The method of claim 1, further comprising resuming drilling.

4. The method of claim 1, further comprising:

maintaining the surface torque on the drill string until the signals related to one of a torque and a rotational speed experienced at the bottom home assembly indicate rotation at the bottom hole assembly; and reducing the surface torque by selected amount.

5. The method of claim 4, wherein the selected amount is about forty percent.

6. The method of claim 1, further comprising determining mud flow in an annulus by measuring a fluid temperature in the annulus.

7. The method of claim 6, further comprising altering a rate of the initiation of drilling fluid flow based on the temperature measurement in the annulus.

8. The method of claim 1, wherein lowering the drill bit to the bottom of the hole comprises lowering the drill bit such that a total travel time to the bottom of the borehole is substantially different from half of a fundamental resonance period of the drilling fluid.

9. The method of claim 1, further comprising selecting restart parameters based on a system response during a previous restart of the drilling process.

10. A method of restarting drilling operations in a wellbore after drilling operations and circulation of a drilling mud have ceased, the method comprising the steps of:

providing a wired drill string having a drill bit in the wellbore, downhole sensors positioned in the wellbore and in communication with a controller via the wired drill string, a pumping system to circulate drilling fluid, a rotation system for applying rotation to the drill string and drill bit, a translation system for raising and lowering the drill string relative to the wellbore;

obtaining data at the controller obtained from the downhole sensors communicated via the wired drill pipe, wherein the data relates to one of a torque of the drill bit or drill string and a rotational speed of the drill bit or the drill string;

operating the rotation system to apply torque to the wired drill string based on the data until the drill string begins rotating and then automatically reducing the torque; and initiating the pumping system to circulate drilling fluid at a first flow rate upon receiving data at the controller from the downhole sensors indicating that a downhole transient pressure surge has passed.

11. The method of claim 10, wherein if rotation of the drill string proximate to the drill bit is not detected by the downhole sensors in approximately a time corresponding to the transit time of rotational waves in the drill string tool from the rotating system to the drill bit then the torque applied to the drill string by the rotating system is increased.

12. The method of claim 10, wherein the flow rate of the drilling fluid is increased upon receipt at the controller of data indicating an increase of bottomhole pressure of the drilling fluid in the interior of the drill pipe.

13. The method of claim 10, further including the steps of:

operating the translation system to lower the drillbit to bottom of the wellbore upon achieving a desired drilling mud flow rate; and controlling the rate of descent of the drillpipe to minimize the surge pressure in the wellbore.

* * * * *